United States Patent [19]

Nakajima

[11] Patent Number: 4,956,989

[45] Date of Patent: Sep. 18, 1990

[54] METHOD OF FORMING A COLLAR FOR HEATING EXCHANGER FIN AND DIE FOR USE THEREIN

[75] Inventor: Kazuto Nakajima, Yamatokouriyama, Japan

[73] Assignee: Matsushita Electric Industrial Co., Ltd., Osaka, Japan

[21] Appl. No.: 334,886

[22] Filed: Mar. 30, 1989

[30] Foreign Application Priority Data

Mar. 31, 1988 [JP] Japan ..... 63-80819

[51] Int. Cl.[5] ..... B21D 28/14; B21D 28/26

[52] U.S. Cl. ..... 72/327; 72/335

[58] Field of Search ..... 72/327–328, 72/333–335, 324

[56] References Cited

U.S. PATENT DOCUMENTS

| | | | |
|---|---|---|---|
| 235,353 | 12/1880 | Geldreich | 72/328 |
| 1,690,523 | 11/1928 | Bell | 72/328 |
| 2,308,953 | 1/1943 | Brown | 72/327 |
| 3,146,749 | 9/1964 | Heinle | 72/335 |
| 4,098,108 | 7/1978 | Kozima | 72/335 |

FOREIGN PATENT DOCUMENTS

| | | | |
|---|---|---|---|
| 25816 | 2/1983 | Japan | 72/327 |
| 721183 | 3/1980 | U.S.S.R. | 72/334 |
| 816626 | 4/1981 | U.S.S.R. | 72/333 |
| 255598 | 7/1926 | United Kingdom | 72/333 |

*Primary Examiner*—Daniel C. Crane

*Attorney, Agent, or Firm*—Wenderoth, Lind & Ponack

[57] ABSTRACT

A method of forming a collar-shaped protrusion on thin plate material by relatively bringing a forming punch having the outer diameter varying stepwise into the forming hole of a forming die and during forming, punching a small diameter hole by means of a punch-through punch incorporated in said forming die. During the remainder of forming, ironing and burring are performed on the protrusion to form a collar for heat exchanger fins. The die set shaped for carrying out the steps is also included. Since these steps can be performed as a single continuous series of steps, heat exchanger fins of high accuracy can be manufactured with fewer tools, and at less cost and in less time than heretofore.

5 Claims, 3 Drawing Sheets

METHOD OF FORMING A COLLAR FOR HEATING EXCHANGER FIN AND DIE FOR USE THEREIN

FIELD OF THE INVENTION

This invention relates to a method of forming a collar employed in the production process of fins employed in the heat exchanger, and the die required for its production.

BACKGROUND OF THE INVENTION

The heat exchangers provided in the exterior and interior air conditioner units consist of a multi-folded refrigerant pipe which goes through a large number of fins parallelly disposed at a proper inter-fin distance, and these fins and pipe are fixed together.

The inter-fin gap is defined by the height of a collar protruding from the plate form fin material, and therefore the accuracy and performance of said heat exchanger depends largely on the accuracy of the collar height and the finish of its end portion. When a larger inter-fin distance has to be provided, a higher collar height is naturally required, and this will be accompanied by an increased difficulty to in attaining the required accuracy and performance.

As shown by Japanese Patent Publication Sho 54-31754, for example, the conventional collar forming process has been comprised of a first process consisting of forming a small diameter hole which is, at the same time, succeeded by the formation of a vertical cylinder having a diameter smaller than the required collar diameter on a specified part of a plate material, and a second process consisting of ironing and burring processes simultaneously performed by using a punch having a diameter matched to a desired collar diameter.

The details of the process are further explained by referring to FIGS. 3A–3D of the present application where a small diameter hole 33 is first formed in the material 31 by using a punch 32 to punch out the small diameter hole, and after this process, a punch 35 matched to a die 34 is inserted into said die 34 to form a small vertical cylinder 36 on said material 31 (see FIGS. 3(A) and 3(B)). Said material 31 is then placed below another die 37 in the succeeding process, and said small vertical cylinder 36 is formed into a desired collar 39 by using a punch 38 matched to said die 37 (see FIGS. 3(C) and 3(D)).

However, the process as described above is divided into a first part by which a vertical cylinder having a smaller diameter than the desired collar diameter is formed, and a second part by which the hole and collar of a desired diameter is formed, and therefore, it is impossible to accomplish a perfect coincidence between the center of the vertical cylinder having a small diameter hole formed by said first part and the center of the desired collar formed by said second part, and thus, said ironing and burring processes have to be carried out while allowing for a small discrepancy, and this causes problems such as the breakage of the collar and uneven collar height due to the discrepancy between two machining positions (see FIGS. 4(A) and 4(B)). Moreover, cracks are often generated at the top edge of the collar since the tensile stress at the time of hole expansion is concentrated on the edge of said small diameter hole since the material is protruded over the rim of said small diameter hole, and a further expansion of hole is performed in said second part (see FIG. 4(C)). Because of the independent first and second machining process parts separate tools have to be prepared, and this causes increased costs. And moreover, when a higher collar height is desired, a third part by which the burring process has to be further extended, has to be provided.

DISCLOSURE OF THE INVENTION

The primary object of present invention is to provide a new collar forming method and the dies for this by which high accuracy and low cost fins of various collar height for a heat exchanger can be produced by a single machining process without producing any uneven collar height and cracks at the collar top.

The object of present invention can be accomplished by using a forming punch having a punch-through hole at the center, a rounded corner at the top, and a guide portion with outer diameters changed stepwise, a forming die having an internal knockout collar which is made to fit the maximum diameter of said guide portion of said forming punch and made slidable by means of a spring, and a punch-through punch inserted in said knockout collar for performing the punching of plate material while its expansion is being performed by means of the top portion of said forming punch and forming die, and for inserting the guide portion of said forming punch succeedingly into said forming die. Moreover, according to the present invention, the height of said expansion can be set at a desired value by changing the height position of said punchthrough punch for forming a collar of a desired height.

Since the punching of the hole is performed while a fair amount of expansion is being performed before a small diameter hole is punched out by means of said punch-through punch at the desired position of the plate material, the amount of hole expansion is smaller, and the amount of formed expansion can be converted into the height of the collar. Moreover, by engaging the guide portion where the outer diameter of said forming punch is changed stepwise, into the forming die, the process can proceed from the ironing to burring as the outer diameter of forming punch changes from its minimum to maximum during said forming process, and thus, the cylindrical collar can be formed by a single process by executing this continuous serial operation. Furthermore, the expansion forming height can be altered for a desired collar height by the alteration of punch timing by adjusting the punch-through punch setting height.

BRIEF DESCRIPTION ON THE DRAWINGS

THE BEST MODE OF THE INVENTION

An explanation of an embodiment of the invention in a method and dies to form a collar for heat exchanger fins is now given in the following.

Figure 1:
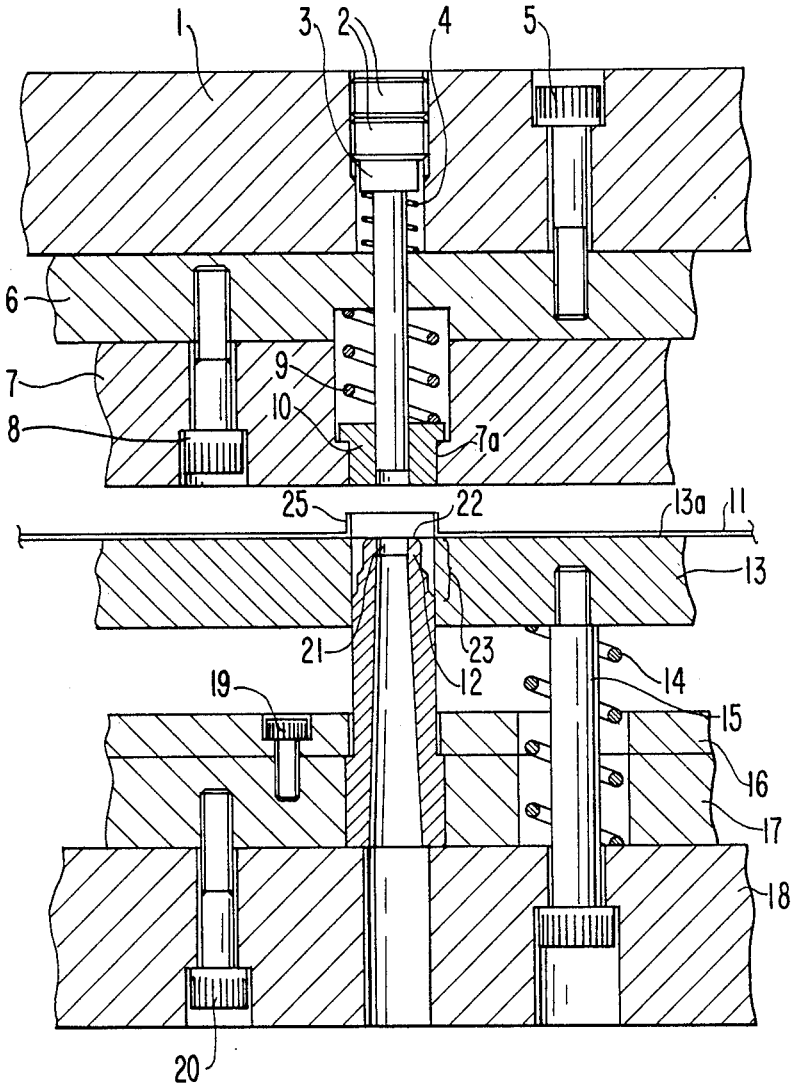
FIG. 1 is a cross-sectional diagram of the die tools of an embodiment of the invention for forming a collar for heat exchanger fins.

A cross-sectional diagram of the set of die tools of an embodiment of invention for forming a collar for heat exchanger fins is shown in FIG. 1, where 1 designates an upper die to be fixed on the ram side of a press (not shown), 2 designates a headless setscrew with a hexagon socket to set the height of punch-through punch 3. Said punch-through punch 3 is prevented from falling by the spring 4 and is held so as to be slidable in the axial direction by means of a punch plate 6 which is fixed on said upper die 1 by a bolt 5. A forming die 7 is provided having a forming hole 7*a* for receiving the maximum diameter part of a guide portion of a forming punch 12 and having an internal knockout collar 10 slidable in hole 7*a*. A bolt 8 fixes said forming die 7 to said punch plate 6. A spring 9 is provided to press said internal knockout collar 10 toward said forming punch 12, and by the pressing force thereof, a collar 25 formed from an aluminum plate material 11 is pushed out of said die 7. The forming punch 12 has a punch-through hole portion 21 at the center and a rounded edge 22 at its top, and a guide portion 23 with parts having outer diameters increasing stepwise in the axial direction to the maximum diameter part. A stripper 13 is provided to disengage said forming punch 12 and a collar 20 formed by punching out the aluminum plate material 11 after said aluminum plate material 11 is punched by said forming punch 12. A spring 14 urges said stripper 13 in the direction to strip the aluminum plate material 11. A bolt 15 is provided to support and fix the position of said stripper 13 assisted by the force supplied by said spring 14. A holding plate 16 holds said forming punch 12 in a punch plate 17 against a lower die 18 positioned and fixed on the bolster side of a press machine. A bolt 19 fixes said holding plate 16 on said punch plate 17, and a bolt 20 fixes said punch plate 17 on said lower die 18.

Figure 2A:
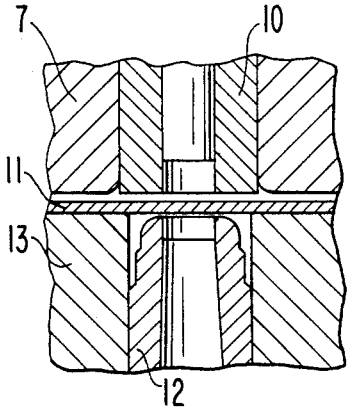
FIGS. 2A–2F are partial cross-sectional diagrams showing the parts of the collar forming process.
Figure 2B:
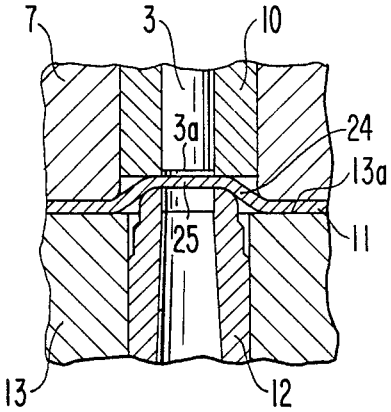
Figure 2C:
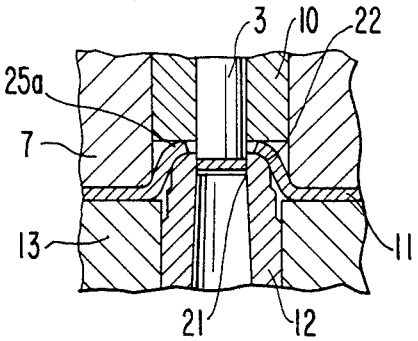
Figure 2D:
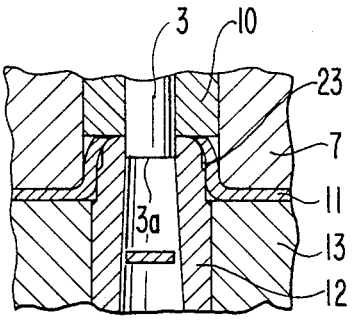
Figure 2E:
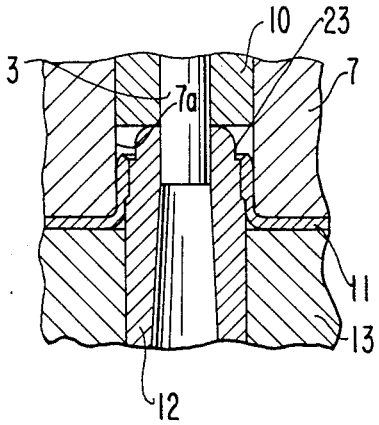
Figure 2F:
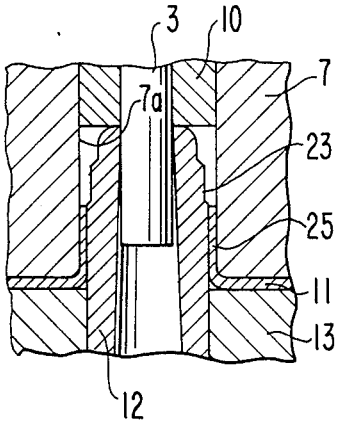
Figures 3A, 3B, 3C, 3D:
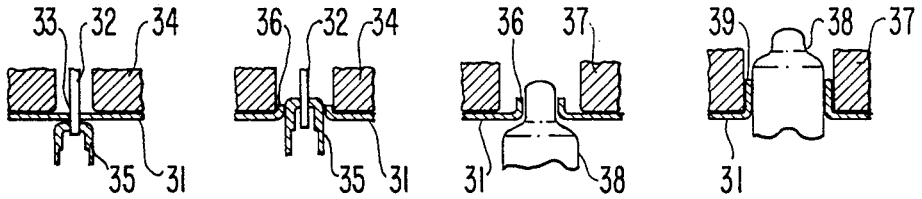
FIGS. 3A–3D are partial cross-sectional diagrams showing the forming processes according to a conventional collar forming method to form heat exchanger fins.
Figure 4A:
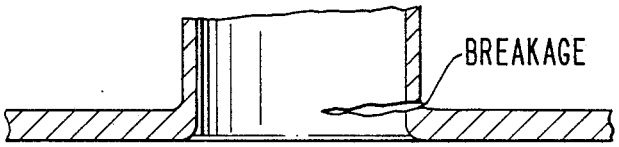
FIGS. 4A, 4B and 4C are cross-sectional diagrams showing a few failures observed after the collar forming process of FIGS. 3A–3D is finished.
Figure 4B:
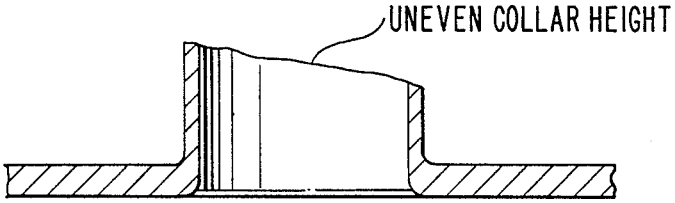
Figure 4C:
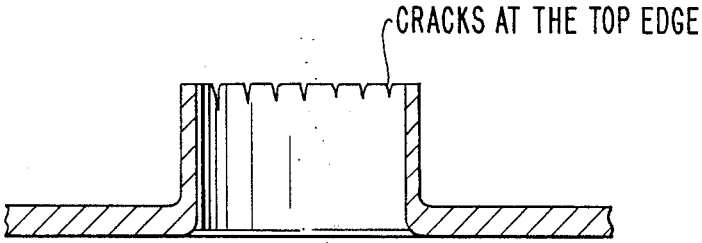

The process of forming the collar for heat exchanger fins is now explained by referring to FIGS. 1 and 2A–2E. At first, the aluminum plate material 11 is placed on the stripper 13 (FIG. 2 (A)), and then, the upper die 1, the punch plate 6 and forming die 7 are lowered together by lowering the ram (not shown). The aluminum plate material 11 is pressed between said stripper 13 and forming die 7, and by lowering the forming die 7 further, the stripper 13 is simultaneously lowered against the force of spring 14 while the aluminum plate material is held against the forming die 7. Then the forming punch 12 starts gradually to form a protrusion 24 on the held aluminum plate above the upper surface 13*a* of stripper 13 as the stripper 13 is lowered, and the knockout collar 10 incorporated in the forming die 7 is pushed upward against the force of spring 9 while remaining in contact against the protrusion 24 (FIG. 2(B)). As the forming die 7 is further lowered, the forming punch 12 extends further into the forming die 7, and the 25*a* of the protrusion reaches the lower surface 3*a* of the punch-through punch 3 which extends through the knockout collar 10, and the vertical position of which is determined by the headless set-screw 2, while the expansion of plate 11 is further produced by the rounded edge 22 of forming punch 12, the punching of a hole is performed between the punch-through punch 3 and punch hole portion 21 (FIG. 2 (C)). As the forming die 7 is further lowered, ironing and burring processes are succeedingly executed between the guide portion 23 of forming punch 12 and the forming hole 7*a* of forming die 7 until a cylindrical collar 25 is formed (FIG. 2(D)–2(F)).

According to an embodiment of this invention, a forming punch having a punch-through hole at its axial center, a rounded edge at its top, and a guide portion having outer diameters increasing stepwise is inserted in a forming die having a slidable internal knockout collar and a forming hole for receiving the maximum diameter of said guide portion of the forming punch against the force of a spring to form a protrusion on an aluminum plate material.

Since a small diameter hole is formed after a significant part of a protrusion is formed, and a hole is formed by means of the punch-through punch which extends through the knock-out collar 10, the vertical position of which punch is fixed at a proper height and which is removable from behind, the generation of cracks on the collar edge during the expansion of the hole can be prevented better than in the conventional case where formation of the expansion portion is performed after the hole punching is performed. Since the amount of protrusion of aluminum plate material is a major factor to determine the dimension of the collar end, the formation of a collar having a still higher collar height is possible by conducting a preliminary expansion shown in this embodiment. Since the punch-through timing can be adjusted by adjusting the vertical position of the punch-through punch, as a result of this, the height of the expanded portion can be so changed that a collar of desired height can be obtained.

Since this forming process is performed in a single operation, any pitch discrepancy which may occur between plural processes can be eliminated, so that the collar edge height can be made uniform, and at the same time, the number of tools and thus the tool costs can be substantially reduced.

In the above described embodiment, a spring 4 is provided for the purpose of supporting the punch-through punch at an upper position, but if the collar height is set to be constant and need not be altered, the structure can be simplified and said punch-through punch can be made detachable by means of a set of set-screws, and said spring 4 can be omitted.

The object of the present invention can be accomplished by using a forming punch having a punch-through hole at the center, a rounded edge at its top, and a guide portion having outer diameters increasing stepwise, a forming die having an internal knockout collar and having a forming hole which is made to accommodate the maximum diameter part of said guide portion of said forming punch and which knock-out collar is slidable by means of a spring, and a punch-through punch slidable through said knockout collar for performing the punching of a plate material while expansion of the plate material is being performed by means of the top portion of said forming punch and said forming die, and inserting the guide portion of said forming punch into said forming die to form a collar.

Therefore, said collar can be formed by a single process according to the present invention, and the height of the collar can be set at a desired value by changing the vertical position of said punch-through punch for obtaining a collar having a desired height. Furthermore, as the result of this method, a collar having a higher collar height can be formed by suppressing the crack generation at the top portion of collar without breakage of the collar and uneven collar height due to the machining position discrepancy, and a fin of higher accuracy can be manufactured at low cost because of the reduced number of tools.

We claim:

1. A method of forming a collar for heat exchanger fins, comprising:

providing a die set having a forming punch with a central axial punch-through hole therein, a free end with a rounded edge thereon and a guide portion having a plurality of successively larger outer diameter portions in succession from the free end, and a forming die in opposition to said forming punch and having a forming hole therein with an outer end and with a knockout collar slidable in said forming hole and a spring means urging said knockout collar toward the outer end of said forming hole and with a punch-through punch fixed in said knockout collar at a position spaced inwardly from the outer end of said forming hole and fittable into said punch-through hole in said forming punch for punching a hole in a sheet of material;

positioning a metal plate in which a collar is to be formed between said forming punch and said forming die and over said punch-through hole;

bringing said forming punch and said forming die together to move said forming punch into said forming hole and causing said knockout collar to yieldably engage said sheet material for first deforming the metal plate into said forming hole toward said punch-through punch for starting the formation of the collar;

continuing to move said forming punch and said forming die together to force said free end of said forming punch and said punch-through punch past each other for punching a hole in said deformed portion of said metal plate; and continuing to move said forming punch and said forming die together to move said successive larger diameter portions of said forming punch into said forming hole for forming the desired collar.

2. A method as claimed in claim 1 in which said step of continuing to move said forming punch and said forming die together to move said succesive larger diameter portions of said forming punch into said forming hole comprises carrying out said movement for performing ironing and burring on said collar.

3. A die set for forming a collar for heat exchanger fins, comprising:

a forming punch with a central axial punch-through hole therein, a free end with a rounded edge thereon and a guide portion having a plurality of successively larger outer diameter portions in succession from the free end, and a forming die in opposed relationship to said forming punch and having a forming hole therein with an outer end and with a knockout collar slidable in said forming hole and a spring means urging said knockout collar toward the outer end of said forming hole and with a punch-through punch fixed in said knockout collar at a position spaced inwardly from the outer end of said forming hole and fittable into said punch-through hole in said forming punch for punching a hole in a sheet of material, said forming punch cooperating with said knockout collar and forming die to deform said sheet material towards said punch-through punch with said knockout collar yieldably engaging said sheet material followed by said punch-through punch punching a hole into said sheet material by entering said punch-through hole, and continued movement of said forming punch and forming die causing the surrounding area of the hole of the punched sheet material to be shaped against the forming hole by the successively larger diameter portions to form the collar.

4. A die set as claimed in claim 3 further comprising means for adjustably fixing said punch-through punch at positions between said firstmentioned position and a further position spaced further inwardly from the outer end of saaid forming hole.

5. A die set as claimed in claim 3 further comprising a stripper slidably mounted around said forming punch and having spring means urging said stripper toward the free end of said forming punch to a position where it can strip a sheet of material off said forming punch.

* * * * *